United States Patent [19]

Cheek

[11] Patent Number: 4,515,403

[45] Date of Patent: May 7, 1985

[54] OVERSHOT

[76] Inventor: Alton E. Cheek, 1949 Vuelta Grande Ave., Long Beach, Calif. 90815

[21] Appl. No.: 399,139

[22] Filed: Jul. 16, 1982

[51] Int. Cl.[3] ..... E21B 31/02

[52] U.S. Cl. ..... 294/86.31

[58] Field of Search ..... 294/86.31, 86.32, 86.34, 294/86.36, 86, 86.18, 86.19, 86.26, 86.27; 175/246, 247, 248

[56] References Cited

U.S. PATENT DOCUMENTS 2,266,873 12/1941 Long ..... 294/86.31

2,507,127 5/1950 True ..... 294/86.31

*Primary Examiner*—James B. Marbert

*Attorney, Agent, or Firm*—Albert E. Gabriel

[57] ABSTRACT

An overshot for the handling and retrieval of "drop" type well survey instruments that are employed in directional drilling. The overshot has an elongated, generally cylindrical body with a pair of elongated, generally longitudinally arranged, diametrically opposed locking arms mounted therein for both longitudinal sliding and radial tilting movement. The locking arms are longitudinally biased by means of a spring-loaded plunger axially centered in the body, such biasing causing the arms to be cammed radially inwardly toward their locking positions.

12 Claims, 13 Drawing Figures

OVERSHOT

BACKGROUND OF THE INVENTION

1. Field of the Invention

The invention relates to overshots employed in the handling and retrieval of "drop" type well survey instruments that are employed in directional drilling.

2. Description of the Prior Art

Directional drilling is currently widely utilized for the efficient exploitation of oil fields, but requires great accuracy in drill orientation as to both azimuth and inclination or drift angle. Thus, a requirement of directional drilling is that the azimuth and inclination angles of the drill be monitored, at least periodically, by a downhole survey instrument. One general type of survey instrument is the "drop" type that is adapted to be dropped down through the drill string to land proximate the bottom, and this may be either a "single shot" or "multiple shot" directional survey instrument depending upon the number of timed photographic shots that are taken of the instrumentation.

The drop type survey instrument is contained in a survey barrel assembly which is made up in a survey instrument string which usually contains non-magnetic spacer bars above and below the survey barrel assembly, and which terminates at its upper end in a spear point that is adapted to be releasably latched or locked to an overshot that is suspended from a wire line or other flexible line in a derrick for lowering of the survey instrument string into the upper part of the drill string in preparation for drop, and for retrieval of the survey instrument string from the drill collars as the string is being pulled from the well after the survey instrument readings have been photographically recorded by the single or multiple shots.

The overshot is required to have a downwardly opening receptacle with spring-loaded locking fingers that will automatically latch or lock over the enlarged tip of the spear point when the latter is engaged in the receptacle. Manual release means must be externally accessible along the sides of the overshot.

Historically, the basic problem in the art has been to achieve a strong, positive radially inwardly directed locking force of the gripping fingers over the spear point, with strong and reliable working parts, but within a very narrow outer diameter limitation for the overshot. The typical survey instrument string has an O.D. of only $1\frac{3}{4}$ inch for freedom of movement when it is dropped down through the drill string and when it is later retrieved from the drill collars. Correspondingly, it is desirable that the overshot have an O.D. along its length no greater than that of the survey instrument string, i.e., no greater than $1\frac{3}{4}$ inch.

Not only is the outer diameter of the overshot thus strictly limited, but also the inner diameter of the downwardly opening receptacle part must be as large as possible so that the engaged upper end part of the spear point can have a sufficient diameter to be reliably strong.

The original survey instrument overshot art is the Reed overshot which has gripping arms arranged much like a pair of ice tongs that are biased toward the engaged position by a pair of peripherally exposed leaf springs. The Reed device had a number of serious problems. A basic problem was that it had too large a diameter at the gripping part, so that when it was lowered down into the drill string for retrieval of the survey instrument string it could not get through restricted regions of the drill string. If the gripping part were made diametrically smaller, then the engaged part of the spear point would have had to be so thin that it would be too weak. The exposed springs had a cantilever type action which limited the amount of gripping force that was available. Another, serious problem with the exposed leaf springs was that if the tool got cocked in a narrow region or turn in the drill string, the exposed springs could be accidentally depressed radially inwardly so as to release the gripping part and allow the instrument string to inadvertently drop to the bottom.

One attempt to overcome these problems of the Reed device was the Kuster overshot. This device employed a pair of gripping arms which were loosely floatingly held in a transverse slot and biased downwardly against cam ramps to their gripping positions by means of an external, peripheral coil spring. While the cam ramp gripping action is a good type of action for providing good radial inward gripping force within a relatively narrow radial thickness of the tool, the external coil or helical spring on the Kuster tool caused problems. One such problem was the fact that the external helical spring had to be threaded over a series of external projections on the tool during assembly, which made assembly difficult. A similar difficult unthreading was required for disassembly. In order to permit the external spring to be threaded into its operative position during assembly, the spring had to be a relatively weak one, which limited the amount of gripping force available in the tool. Also, since the two gripping arms independently floated against diametrically opposite sides of the spring, the arms became readily axially displaced relative to each other, so that positive and simultaneous locking and unlocking was not assured with this tool. A still further problem with the Kuster type overshoot was that in addition to the externally exposed helical spring, the tool had series of radial projections or irregularities which could catch on some obstruction.

SUMMARY OF THE INVENTION

In view of these and other problems in the art, it is a general object of the present invention to provide an overshot for the handling and retrieval of a survey instrument string, wherein the overshot has a spring-loaded gripping action that is strong, positive and reliable, and which has no limitation on the amount of gripping force that is available.

Another object of the invention is to provide a survey instrument overshot wherein the biasing force for the gripping arms is provided by an axially arranged, helical spring which is entirely internally contained within the body of the tool, thus completely eliminating external leaf or helical springs.

A further object of the invention is to provide a survey instrument overshot wherein all of the parts, including the gripping arms, are sufficiently thick to be strong and reliable, yet which has a spear point-receiving receptacle portion that is relatively thin in the radial direction, enabling a relatively thick and hence strong spear point to be employed.

A still further object of the invention is to provide a survey instrument overshot wherein a plurality of gripping arms are at all times in axial registry. Another object is to provide a survey instrument overshot which has an O.D. along its entire length no greater than the O.D. of a conventional survey instrument string, yet which has a smooth, generally uninterrupted exterior that has no likelihood of hanging up on obstructions. The overshot of the present invention has a unitary body with a downwardly opening receptacle in its lower end for receiving a spear point, a transverse, diametrical slot in the longitudinally central part of the body and extending down into the receptacle, and a central bore in the upper part of the body communicating with the upper end of the transverse slot. A pair of locking arms is mounted in diametrically opposed relationship in the transverse slot for a rocking action that includes both longitudinal sliding and radial pivoting movements, the locking arms having gripping fingers located in the region of the receptacle. A control plunger is axially slidable in the upper bore of the body, extending downwardly into the transverse slot and engaging the locking arms. A helical compression spring above the plunger in the upper bore of the body, which may be as strong a spring as desired, biases the control plunger and locking arms downwardly, with the lower ends of the locking arms being cammed radially inwardly against the body, to a latched or locked position over the upper end of a spear point in the receptacle part of the body. Transverse pins mounted in the body extend through longitudinal slots in the locking arms for limiting downward movement of the locking arms, and hence inward radial movement of gripping fingers at the lower ends of the locking arms. Upper end lugs on the locking arms are peripherally exposed in diametrically opposed cutouts in the body for manual retraction of the locking arms to release the spear point from the receptacle.

BRIEF DESCRIPTION OF THE DRAWINGS

These and other objects of the invention will become more apparent in reference to the following description and the accompanying drawings, wherein.

DETAILED DESCRIPTION

Figure 1:
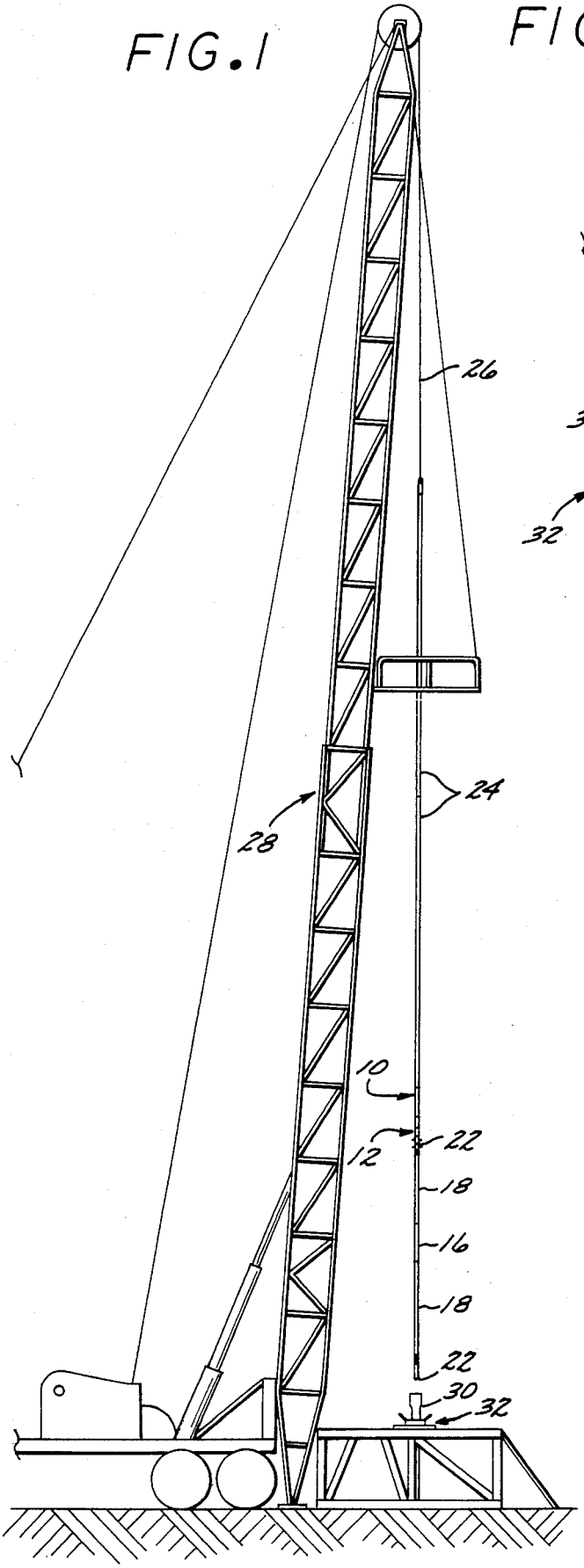
FIG. 1 is a side elevational view showing the overshot of the present invention suspended from a derrick and locked or latched onto the upper end of a survey instrument string in preparation for lowering the survey instrument string into the upper end of a drill string.
Figure 2:
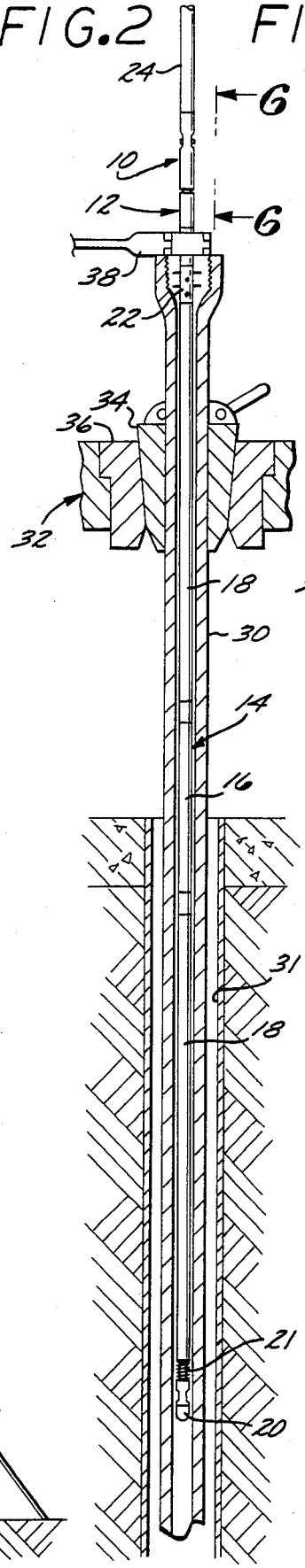
FIG. 2 is a vertical section, partly in elevation, illustrating the survey instrument string lowered into the upper portion of the drill string and secured by other means such as tongs, prior to release of the overshot of the invention from the upper end of the survey instrument string.
Figure 3:
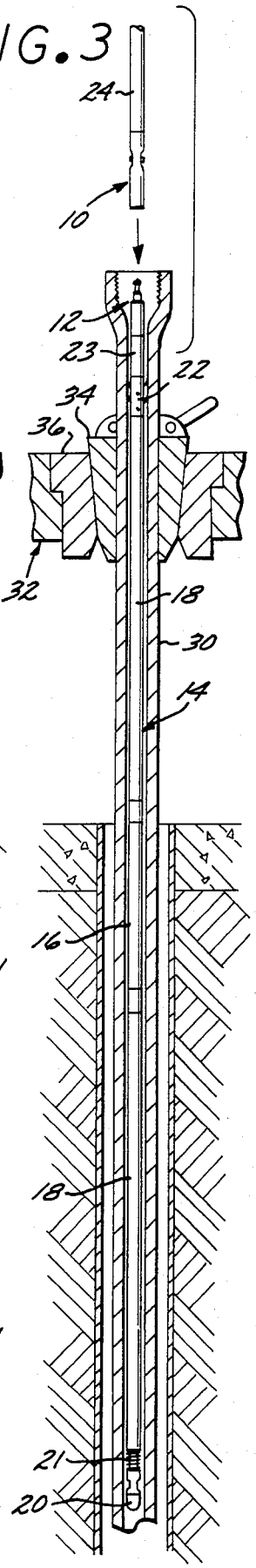
FIG. 3 is a view similar to FIG. 2, but after separation of the overshot from the spear point at the upper end of the survey instrument string, and after release of the survey instrument string from the tongs.

Referring to the drawings, the overshot of the present invention is generally designated 10, and the manner in which it is utilized in the handling of a survey instrument string above ground level is illustrated in FIGS. 1–3 of the drawings.

The overshot 10 has a lower portion that is engageable and lockable over a spear point generally designated 12 that is connected to the upper end of a survey instrument string generally designated 14. The sensing and recording section of the survey string 14 is a survey barrel assembly 16 which typically contains a magnetic survey instrument. Such instrument generally contains a compass and angle unit which provides readings of azimuth and angle of inclination, and a photographic camera which is adapted to take either a single timed photographic shot or a series of photographic shots at timed intervals, these shots being timed from a starting time that is set above ground before the survey instrument string 14 is released to drop down through the drill string. Such survey instrument photographic "shots" are important in the determination and control of azimuth and angle of inclination in directional drilling. Such "single shot" and "multiple shot" survey instruments are well known in the art, and it is conventional practice to use some form of overshot in the handling and retrieval of a string containing such a survey instrument.

The typical survey instrument is a "magnetic" survey instrument containing a magnetic compass (as well as a gravity-responsive angle sensor), which requires that adjacent portions of the survey instrument string 14 be made of non-magnetic material, and also that one or more drill collars proximate the bottom of the drill string within which the instrument is photographed be made of non-magnetic material. However, it is to be understood that the overshot of the present invention may also be utilized in connection with an angle unit only, in which case non-magnetic portions of the survey instrument string and drill string are not required.

Figure 4:
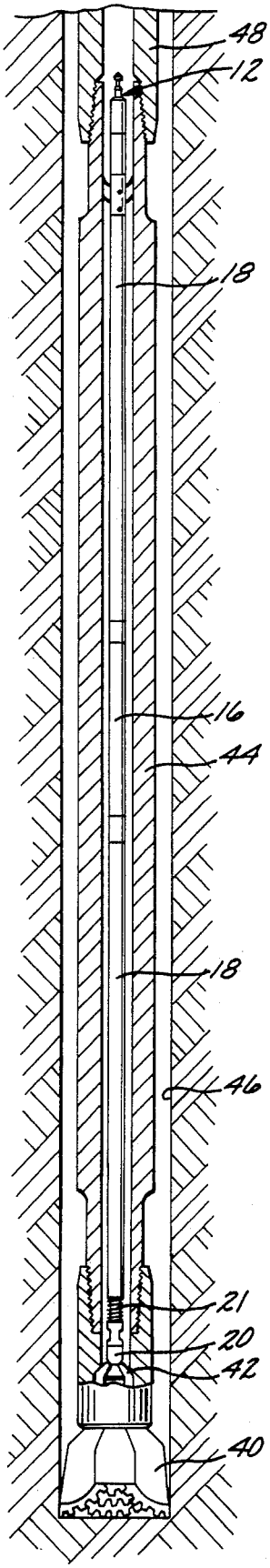
FIG. 4 is a vertical section, partly in elevation, illustrating the survey instrument string in its landed position proximate the lower end of the drill string and within a non-magnetic drill collar.

The survey instrument string 14 includes, in addition to the survey barrel assembly 16, non-magnetic spacer bars above and below the survey barrel assembly 16. Non-magnetic spacer bars 18 are arranged so as to space the survey instrument approximately one to two feet below the center of the non-magnetic drill collar or collars employed proximate the lower end of the drill string, as illustrated in FIG. 4 and described in connection therewith. The spacer bars 18 add weight to the survey barrel assembly 16 to expedite the descent of survey barrel assembly 16 down through the drill string when the survey instrument string 14 is dropped. The non-magnetic spacer bars 18 are conventionally made of aluminum, but if extra weight is desired in the survey instrument string 14, one or more of the spacer bars 18 may be made of a heavier non-magnetic material such as brass.

At the lower end of survey instrument string 14 is a bottom landing 20 connected to the lowermost spacer bar 18 through a shock-absorbing spring 21. The upper end portion of survey instrument string 14 may include a rubber pin centralizer section 22 and an upper end sub 23 to which the spear point 12 is connected.

The overshot 10 is connected to the lower end of a string of one or more sinker bars 24 which are suspended on a wire line 26 or other flexible line in a derrick 28. The sinker bars 24 may be of ordinary steel, and serve as weights for lowering the overshot 10 down into the drill collars when the overshot 10 is employed to retrieve the survey instrument string 14 when the latter is brought up with the drill string after the survey shot or shots have been made.

In preparing the survey instrument for being dropped down through the drill string, the survey instrument string is made up in the derrick 28 and the overshot 10 is attached to the spear point 12 at the top of string 14. The survey instrument string 14 is then lowered on the wire line 26 down into drill pipe 30 at the upper end of the drill string and within the cased upper portion 31 of the well bore. The upper section of drill pipe 30 is held in a rotary table generally designated 32, being gripped between slips 34 in the slip bushing 36 of rotary table 32. The survey instrument string 14 is lowered down into the drill string 30 until just the upper end portion of the instrument string 14 remains above the upper end of drill string 30 as shown in FIG. 2, and the survey instrument string 14 is then gripped by conventional means such as tongs 38, or slots in the upper end portion of the survey instrument string 14 that are engaged by metal plates (such slots and plates not being shown), with the survey instrument string 14 suspended down inside of the drill string 30. Then, the overshot 10 is manually released from the spear point 12, and the survey instrument string 14 is then dropped down through the drill string by releasing the tongs 38 or other gripping device. FIG. 3 illustrates the survey instrument string 14 after disengagement from overshot 10 and after release from the tongs 38 or other gripping device.

After thus being released, the survey instrument string 14 then freely drops down in the drilling fluid through the drill pipe and then the drill collars forming the lower portion of the drill string to a location proximate the lower end of the drill string as illustrated in FIG. 4. The bottom landing 20 of the survey instrument string 14 may actually land on the drill bit 40, or as shown in FIG. 4 it may alternatively land on a generally frusto-conical baffle plate 42. Such a baffle plate may be located immediately above the drill bit 40 as illustrated in FIG. 4, or may be located between drill collar joints anywhere from about three to about thirty feet above the bit 40. If the survey instrument is a magnetic instrument, then its landed, operative position proximate the bottom of the drill string will be within one or more non-magnetic drill collars 44 within the lower end portion 46 of the well bore. The non-magnetic drill collar or collars 44 are connected to the lowermost of a series of regular drill collars 48 which form the lower portion of the drill string to provide the required weight for drilling and keep the drill pipe thereabove in tension. The length of the non-magnetic drill collars will depend upon the direction and angle of drilling, and what part of the world the drilling operation is being carried out in. Preferably, the non-magnetic survey instrument string 14 will be substantially coextensive with the non-magnetic drill collars.

The survey instrument string 14 will typically be dropped down to its operative location proximate the lower end of the drill string as shown in FIG. 4 when the drill bit has become dull and the drill string is about to be pulled from the hole anyway. For a single shot directional instrument survey, after the single photograph has been taken at the location shown in FIG. 4, the drill string is then pulled and the survey instrument string 14 is pulled up with the drill string. Then, at any time after the drill collars have reached the surface, the overshot 10, weighted by sinker bars 24, is lowered on the wire line 26 down into the drill collars and automatically snaps into engagement with the spear point 12, so that the survey instrument string 14 can be picked up and retrieved from the remaining drill collars.

If a multiple shot survey instrument is employed in the survey instrument string 14, then a series of timed shots will be taken at selected locations along the well bore as the drill string is being pulled from the bottom location shown in FIG. 4, and then the survey instrument string 14 is retrieved in the same manner as described above for a single shot survey instrument.

The overshot 10 per se and the way it operates with respect to the spear point 12 will now be described with reference to FIGS. 5–13. Overshot 10 has a generally cylindrical body 50. At the lower end of body 50 is a downwardly opening annular recess 52 adapted to receive the shank portion of spear point 12, and stepped inwardly immediately above shank recess 52 is another, longer annular recess 54 adapted to receive the upper tip portion of spear point 12. The successive recesses 52 and 54 together constitute a downwardly opening receptacle cavity in the body 50. Body 50 has a transverse slot 56 extending diametrically therethrough from the lower portion of tip recess 54 upwardly for more than one-half the length of overshot 10. Proximate the upper end portion of transverse slot 56 and in communication with opposite sides of the slot 56 are a pair of diametrically opposed peripheral cutouts 58 in the body 50. Preferably, each of the peripheral cutouts or recesses 58 has its upper end coincident with the upper end of transverse slot 56, and extends downwardly approximately one-third of the length of slot 56. An upper bore 60 extends axially through the upper portion of body 50 from the upper end of transverse slot 56 to the upper end of body 50, the upper bore 60 preferably having a diameter approximately the same as the width of transverse slot 56. An external, upwardly facing tool joint 61 is provided on the upper end of body 50 for threaded connection of body 50 to the lowermost of the sinker bars 24.

A pair of elongated locking arms generally designated 62 are located in diametrically opposite sides of the transverse slot 56. Each of the locking arms 62 has a central body portion 64 through which a transverse pin slot 66 extends, each of the pin slots 66 being elongated generally in the longitudinal direction of its respective locking arm 62. As best shown in FIGS. 7, 8, 10 and 13, each of locking arms 62 is retained in the transverse slot 56 of body 50 by means of a pin 68 which is seated in a respective pin mounting hole 70 extending through body 50 at right angles to the slot 56 and extending through the pin slot 66 of the respective locking arm 62.

Figure 5:
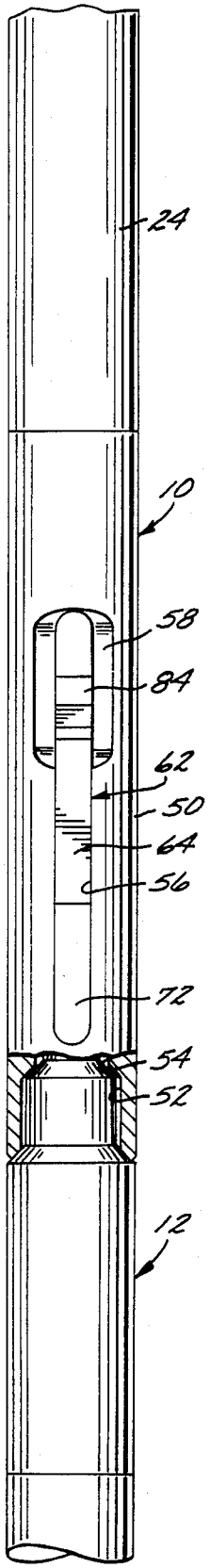
FIG. 5 is a side elevational view of the overshot of the invention, with a portion broken away, showing a spear point with its upper end portion fully engaged within the downwardly opening receptacle of the overshot, past the locking or latching position and prior to tensioning from the weight of the survey instrument string.
Figure 6:
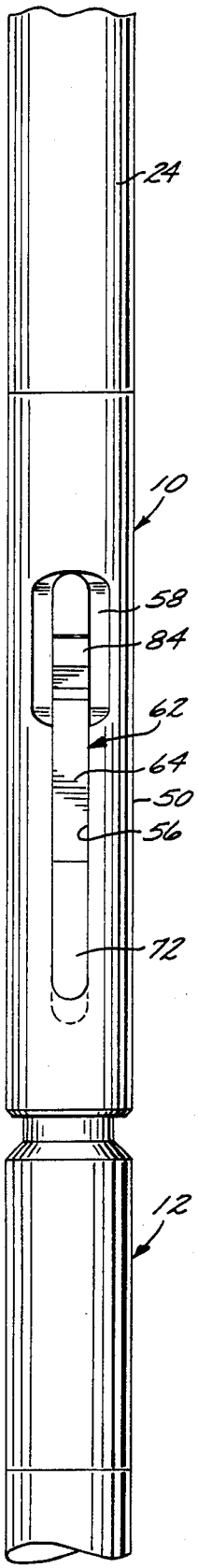
FIG. 6 is a view similar to FIG. 5, without the portion broken away, after the weight of the survey instrument string has been applied and with the overshot fully interlocked with the spear point.
Figure 7:
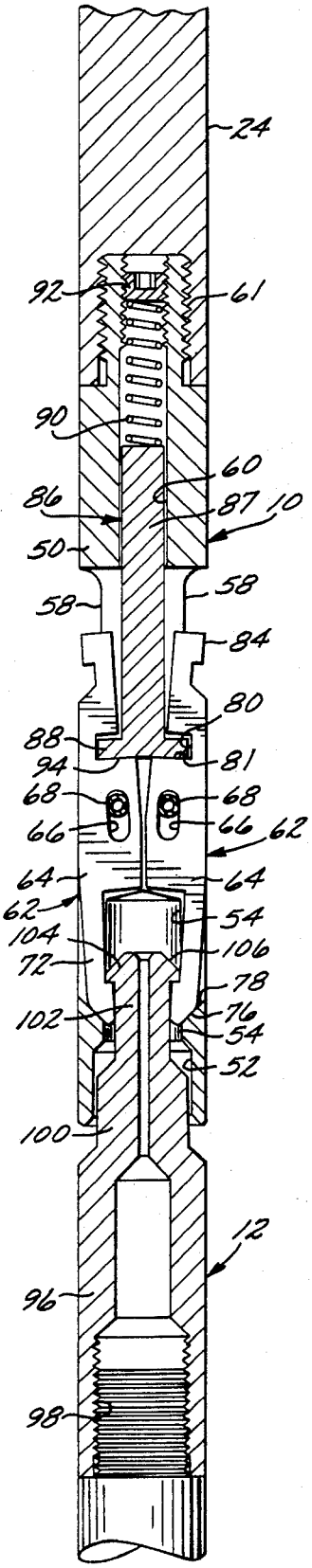
FIG. 7 is a vertical section, partly in elevation, taken 90° from the view of FIG. 6, also showing the overshot fully engaged and locked to the spear point.
Figure 8:
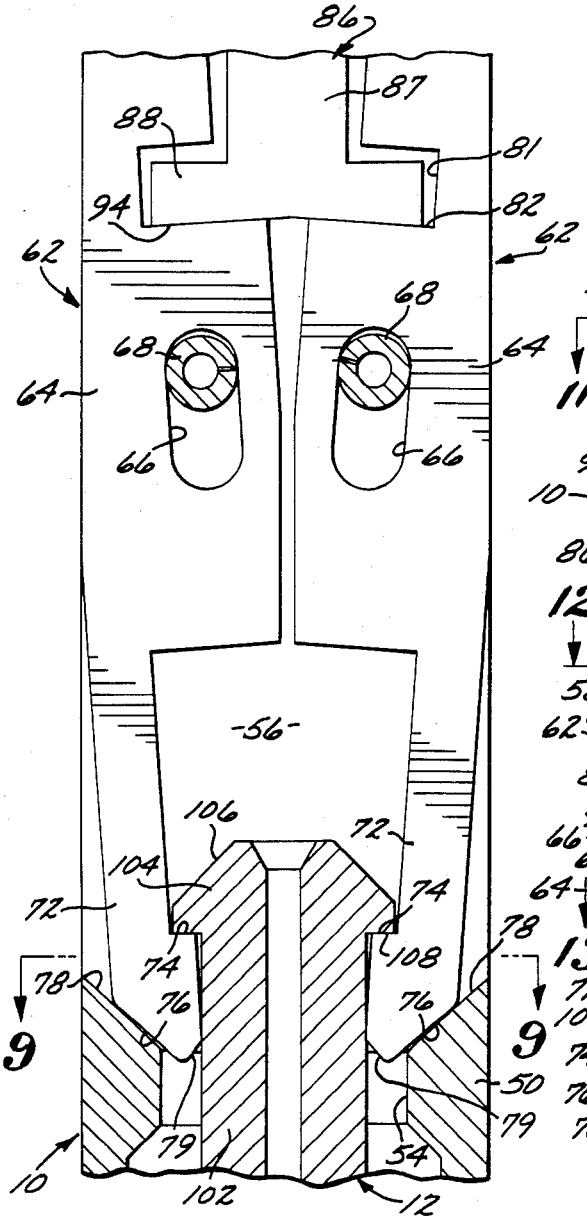
FIG. 8 is an enlarged, fragmentary view of a portion of FIG. 7, showing details of the locking action.

Each of the locking arms 62 has an elongated gripping finger 72 extending longitudinally downwardly from the central body 64, each gripping finger 72 having an upwardly facing, radially inwardly extending catch shoulder 74 on its lower portion adapted to releasably lock under the upper tip of the spear point 12 as best shown in FIGS. 7 and 8. The lower, free end of each gripping finger 72 has a radially outwardly and downwardly facing cam follower bevel 76 thereon which slidably engages against a complementary radially inwardly and upwardly facing cam ramp 78 that forms the lower end of the respective side of transverse slot 56 in the region of tip recess 54 in body 50. The cooperation between each of the cam ramps 78 in body 50 and its respective cam follower bevel 76 on the gripping finger 72 of a locking arm 62 is best seen in FIGS. 7 and 8. The cam follower bevels 76 and cam ramps 78 are preferably rounded or radiused as shown in FIGS. 5 and 6.

At its lower, free end, each of the locking arm gripping fingers 72 is also preferably provided with a small radially inwardly and downwardly-directed chamfer 79 as a guide or lead-in for the upper end of spear point 12 when the overshot 10 is being operatively engaged over the spear point 12. Additionally, the lower ends of gripping fingers 72 below catch shoulders 74 preferably have radially inwardly facing surfaces 80 that are arcuate about the axial center of the body 50 as shown in FIG. 9 for optimum engagement of the gripping fingers 72 about the upper end portion of the spear point 12.

Figure 10:
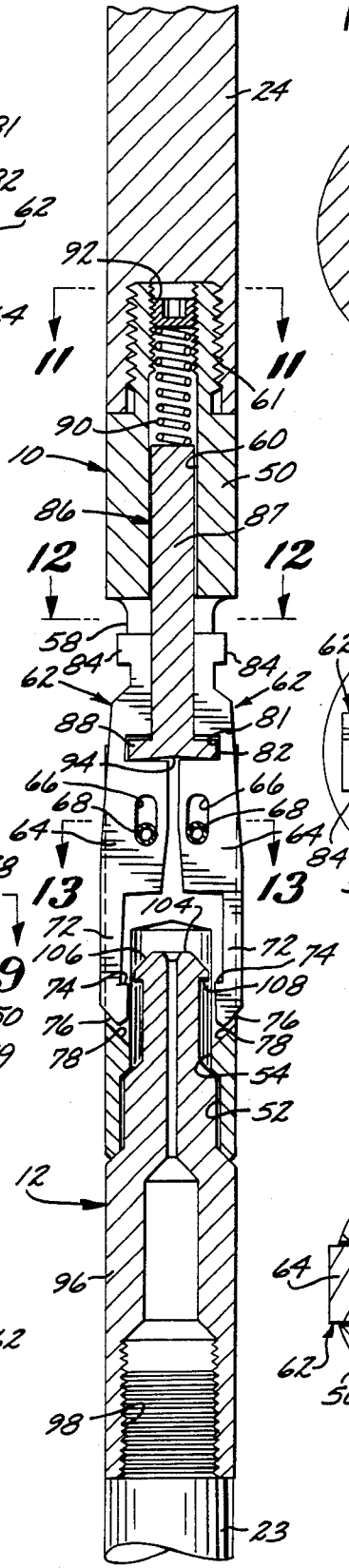
FIG. 10 is a vertical section, partly in elevation, similar to FIG. 7, but with the locking arms in their fully released positions unlocked or unlatched from the spear point.
Figure 11:
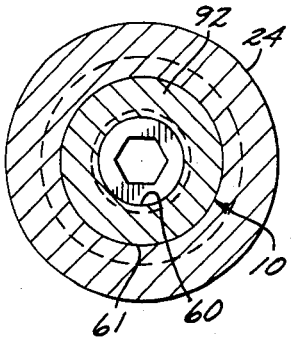
FIG. 11 is a horizontal section taken on the line 11—11 in FIG. 10.
Figure 12:
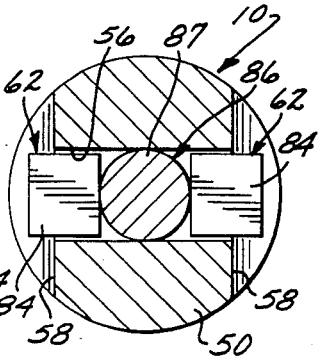
FIG. 12 is a horizontal section taken on the line 12—12 in FIG. 10.
Figure 13:
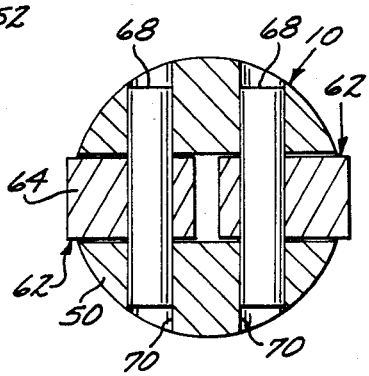
FIG. 13 is a horizontal section taken on the line 13—13 in FIG. 10.

Each of the locking arms 62 has a radially inwardly directed control slot 81 immediately above its central body portion 64. The lower side of each control slot 81 defines an upwardly facing shoulder 82 that is seen in FIGS. 7, 8 and 10. Each of the locking arms 62 is also externally notched near its upper end so as to provide a radially outwardly directed gripping lug 84 at its upper end as shown in FIG. 5–7, 10 and 12. The gripping lugs 84 are adapted to be manually grasped and pulled upwardly and inwardly from the locked positions of the arms 62 shown in FIGS. 5 through 9 to the unlocked positions of the arms 62 shown in FIGS. 10, 12 and 13.

A control plunger 86 has a shank portion 87 slidably engaged in the upper bore 60 of body 50 and extending downwardly between the upper end portions of locking arms 62. The plunger 86 has a crosshead 88 at its lower end that is engaged in the control slots 81 of both locking arms 62. A helical compression spring is disposed within upper bore 60 and retained therein by means of plug 92 threadedly engaged in the upper end of bore 60. The spring 90 biases the control plunger 86 downwardly, the crosshead 88 in turn bearing downwardly against the shoulders 82 of locking arm slots 81 so as to bias the locking arms 62 downwardly. Preferably, the bottom surface 94 of control plunger crosshead 88 is concave in the transverse direction of body slot 56 across which the crosshead 88 partially extends, so that the crosshead 88 bears against the locking arm shoulders 82 at the extreme outer edges of crosshead 88 when the locking arms 62 are withdrawn upwardly as shown in FIG. 10 from their lowermost locking positions. Such contact points of the outer edges of crosshead 88 against shoulders 82 are radially outwardly displaced relative to the pivoting centers of locking arms 62 defined by the pins 68, whereby downward axial biasing force from spring 90 through plunger crosshead 88 causes a torque to be applied to the locking arms 62 upon release of the arms 62 from their withdrawn, upper positions of FIG. 10, which torque tends to close the the gripping fingers 72 about the upper end portion of the overshot 10. Such closing torque on the gripping fingers 72 operates in assistance of a closing cam action of cam ramps 78 against cam follower bevels 76 as control plunger 86 moves locking arms 62 axially downwardly from their unlocked, disengaged positions of FIGS. 10–13 to their locked, engaged positions of FIGS. 5 through 9 upon release of the gripping lugs 84 from the grasp of the operator of the tool.

Figure 9:
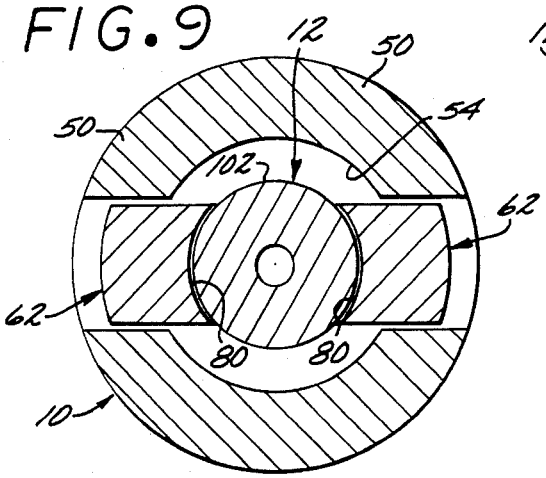
FIG. 9 is a horizontal section taken on the line 9—9 of FIG. 8.

As best seen in FIGS. 7, 8 and 9, the spear point 12, which is of conventional construction, has a body 96 with an internal, downwardly facing tool joint 98 in its lower end for coupling to the upper end member 23 of the survey instrument string 14. Extending coaxially upwardly from the body 96 of spear point 12 is a reduced diameter shank 100 that is engageable within the shank recess 52 of overshot body 50. Then, extending coaxially upwardly from the shank section 100 of spear point 12 is a further reduced diameter nose section 102 which has a diametrically enlarged tip 104 at its upper end. Tip 104 has a radially outwardly and upwardly facing annular centering bevel 106 thereon, and defines a downwardly facing annular shoulder 108. The nose 102 and its enlarged tip 104 are engageable within the tip recess 54 of overshot body 50, and as shown in FIGS. 7–9, in the engaged, locked position of overshot 10 with spear point 12, the nose 102 extends upwardly between the lower end portions of the locking arm gripping fingers 72, and the downwardly facing annular shoulder 108 on the enlarged tip 104 of nose 102 is engaged above the upwardly facing catch shoulders 74 of gripping fingers 72. In this interlocked position of the overshot 10 and spear point 12, the downward force of the weight of the entire survey instrument string 14 is supported by the lower end portions of the gripping fingers 72. This downward force, applied to the catch shoulders 74 of gripping fingers 72, is transferred to the cam ramps on the body 50 through the cam follower bevels 76 on the fingers 72. The cam ramps 78 wedge the lower ends of the fingers 72 radially inwardly against the nose 102 of the spear point as best illustrated in FIG. 8, the weight of the survey instrument string 14 thus providing a very secure interlock between the overshot 10 and the spear point 12.

In the completely relaxed condition of overshot 10 disengaged from spear point 12, the locking arms 62 will be moved forward axially downwardly slightly further than their positions of FIG. 8, with the upper ends of slots 66 bottomed against the pins 68. In such relaxed, disengaged condition of the overshot 10, the gripping fingers 72 will be cammed slightly further radially inwardly by the cam ramps 78 than their positions shown in FIG. 8. As best seen in FIG. 8, the concave bottom surface 94 of control plunger crosshead 88 is preferably shaped as a shallow V, with flat sides opposite the axial center of crosshead 88. The complementary upwardly facing shoulders 82 on locking arms 62 become substantially flush with the respective downwardly facing inclined surface portions of the bottom surface 94 of crosshead 88 in the fully engaged, locked position of overshot 10 as shown in FIG. 8 and also in the fully relaxed, disengaged condition of overshot 10.

When the previously relaxed, disengaged overshot is either manually engaged over the spear point 12, or lowered down into the drill collars by the wire line 26 for retrieval of the survey instrument string 14 and automatically engaged over the spear point 12, the centering bevel 106 on the enlarged upper tip of spear point 12 automatically centers spear point 12 in the downwardly opening lower portions of overshot body 50, as required, as the enlarged tip 104 first enters the shank recess 52 of body 50 and then in sequence enters the radially inwardly stepped tip recess 54 of body 50. Then, as the enlarged tip 104 of overshot 10 passes upwardly through tip recess 54, the centering bevel 106 engages the chamfers 79 at the free lower ends of gripping fingers 72, spreading the fingers 72 radially apart sufficiently to admit passage therethrough of the enlarged tip 104 until the annular tip shoulder 108 latches behind the gripping finger catch shoulders 74. As the enlarged tip of the spear point thus cams the gripping fingers 72 radially outwardly, the cam follower bevels 76 on fingers 72 slide upwardly and outwardly along the cam ramps 78 in the body 50, the locking arms 62 at such time tilting about their respective pins 68 and also sliding rearwardly, with their pin slots 66 enabling such sliding movement. This combined pivoting and upward sliding movement of the locking arms 62 is a rocking type of action which is opposed by the downward biasing force of spring 90 through control plunger 86, and the resulting inward pivoting biasing force on the lower ends of the gripping fingers 72 caused by engagement of the finger cam follower bevels 76 against the respective body cam ramps 78, as well as a small amount of inward biasing force on the gripping fingers 72 by virtue of the fact that as soon as the locking arms commence to tilt from their closed positions of FIG. 8, the outer edges of the plunger crosshead 88 become the only contact points of crosshead 88 against locking arm shoulders 82, which applies biasing force radially outwardly of the pins 68.

Release of the overshot 10 from the spear point 12, and hence from the entire survey instrument string 14, is accomplished by simply manually grasping the gripping lugs 84, with opposing fingers engaged in the notches just below the gripping lugs, and pulling upwardly inwardly on the upper ends of locking arms 62. This then causes the same combined upward sliding and pivoting movements of the locking arms 62 as described above for the engaging procedure, shifting the gripping fingers 72 radially outwardly and upwardly along the cam ramps 78 of the body 50 until the finger shoulders 74 completely clear the spear point shoulder 108, at which time the disengagement is completed. Such rocking movements of the locking arms 62 shift them from the engaged position illustrated in FIGS. 5 through 9 to the disengaged position shown in FIGS. 10–13. Actually, the disengaged position as illustrated in FIG. 10 shows the locking arms 62 shifted all of the way upwardly to their uppermost position permitted by bottoming of the lower ends of slots 66 against the pins 68. In practice, the locking arms 62 do not have to be moved this far upwardly, nor do the gripping fingers 72 have to be swung outwardly as far as shown in FIG. 10.

Then, after the overshot 10 and spear point 12 have been axially separated, release of the gripping lugs 84 will enable the spring 90 and control plunger 86 to move the locking arms 62 back down to their relaxed, unactuated position slightly lower than in FIGS. 7 and 8, ready for another engaging sequence with a spear point 12.

An advantageous feature of the use of the spring-loaded crosshead type control plunger 86 is that it keeps the two locking arms 62 at the same longitudinal position during all conditions of operation of the tool. This assures simultaneous engagement and disengagement of the gripping finger shoulders 82 relative to the spear point shoulder 108. In contrast, the single external helical spring of the Kuster type tool which bears directly upon locking arm shoulders at opposite sides of the tool permits a large amount of relative axial displacement between the two locking arms, so that they may not be engaged or disengaged simultaneously.

Another advantage of the internal spring-loaded control plunger system of the present overshot 10 is ease of assembly and disassembly of the parts, and in particular the ease with which the biasing spring 90 is mounted in the tool. Thus, once the control plunger is located in the body 50 of the tool, with its shank portion 87 inserted upwardly into the upper bore 60 of the body from the transverse slot 56, and then the locking arms 62 positioned in the transverse slot 56 and the locating pins 68 engaged in the body 50, then the spring 90 can be simply inserted into the top of the upper bore 60 and compressed and entrapped under the threaded plug 92. In contrast, the external, encircling helical spring of the Kuster type tool must be threaded axially from the upper end of the tool over a series of radial obstructions into its operative position during assembly, which is a tedious operation. Disassembly involves a similar difficult unthreading of the helical spring. To enable the threading of the Kuster type external spring, the spring is required to be a relatively light or weak spring, which results in a relatively weak gripping action of the gripping arms with the spear point. In contrast, the internal helical spring 90 of the overshot 10 may be as strong as desired, enabling a more positive and secure gripping of the spear point 12 in the overshot 10 to be achieved.

The construction of the present overshot 10 also enables the generally cylindrical exterior of the body 50 of the tool to be much smoother and less interrupted then other types of overshots, so that the present overshot 10 is less likely to catch against other structures in handling. With the construction of the present overshot 10, there is ample room within an outer diameter of $1\frac{3}{4}$ inch (the usual survey instrument string diameter), or within an even smaller diameter if desired, to contain locking arms 62, pins 68, control plunger 86 and spring 90 which have plenty of thickness in all directions, and hence strength and reliability against failure.

While the instant invention has been described with regard to a particular embodiment, modifications may readily be made by those skilled in the art, and it is intended that the claims cover any such modifications which fall within the spirit and scope of the invention.

I claim:

1. An overshot which comprises:

an elongated, generally cylindrical body having a lower portion defining downwardly opening receptacle cavity means;

at least one elongated locking arm generally longitudinally disposed in said body, said arm having a lower gripping finger portion located in said lower body portion with upwardly facing locking shoulder means therein exposed to the inside of said receptacle cavity means, and said arm having an upper portion exposed externally of the body for manipulation of the arm, said arm being both longitudinally slidable and radially tiltable in said body between a lower locking position in which said shoulder means is radially inwardly positioned within said receptacle cavity means and an upper release position in which said shoulder means is substantially radially outwardly displaced from said receptacle cavity means, generally longitudinally directed biasing means within said body and operable between said body and said arm to bias said arm toward its said lower locking position, and, cam means on said body and cooperating cam follower means on said arm for radially tilting said arm so as to move said shoulder means radially inwardly to its said locking position upon downward sliding movement of the arm from its said upper position to its said lower position under the influence of said biasing means, said externally exposed upper portion of said arm enabling the arm to be manipulated from its said locking position to its said release position.

2. An overshot as defined in claim 1, which comprises a pair of said elongated locking arms diametrically oppositely disposed in said body.

3. An overshot as defined in claim 2, wherein said biasing means comprises plunger means generally axially slidable in an upper portion of said body, said plunger means having downwardly facing shoulder means thereon that is engaged against upwardly facing biasing shoulder means on said arms, and spring means in an upper portion of said body operatively engaged against said plunger means so as to bias said plunger means and said arms generally axially downwardly in the body.

4. An overshot as defined in claim 3, wherein said plunger means comprises crosshead means proximate its lower end defining said downwardly facing shoulder means.

5. An overshot as defined in claim 2, 3 or 4, wherein each of said arms has an elongated, generally longitudinally directed, transverse pin slot extending therethrough, and a pair of generally parallel, transverse pins mounted in said body so as to extend through the respective said pin slots of said arms, said pins permitting said longitudinal sliding and radial tilting movements of said arms.

6. An overshot as defined in claim 5, wherein the lowermost positions of said arms in said body are defined by engagement of the upper ends of said pin slots against said pins.

7. An overshot as defined in claim 3, wherein said spring means comprises a helical compression spring generally axially centered within said body.

8. An overshot as defined in claim 4, wherein each of said arms has an elongated, generally longitudinally directed, transverse pin slot extending therethrough, and a pair of generally parallel, transverse pins mounted in said body so as to extend through the respective said pin slots of said arms, said pins permitting said longitudinal sliding and radial tilting movements of said arms, said plunger crosshead means engaging said biasing shoulder means on each of said arms at a location radially outwardly of the tilt center of its respective said pin when said arms are raised above their said lower locking positions so as to tiltingly bias said arms toward their said locking positions.

9. An overshot as defined in claim 1 wherein said cam means comprises surface means in said lower body portion, and said cam follower means comprises surface means proximate the lower end of each said locking arm.

10. An overshot as defined in claim 9, which comprises a pair of said elongated locking arms diametrically oppositely disposed in said body, each of said arms having an elongted, generally longitudinally directed, transverse pin slot extending therethrough, and a pair of generally parallel, transverse pins mounted in said body so as to extend through the respective said pin slots of said arms, said pins permitting said longitudinal sliding and radial tilting movements of said arms.

11. An overshot as defined in claim 10, wherein said biasing means comprises plunger means generally axially slideable in an upper portion of said body, said plunger means having downwardly facing shoulder means thereon that is engaged against upwardly facing shoulder means on said arms, and spring means in an upper portion of said body operatively engaged against said plunger means so as to bias said plunger means and said arms generally axially downwardly in the body.

12. An overshot as defined in claim 11, wherein said plunger means comprises crosshead means proximate its lower end defining said downwardly facing shoulder means.

* * * * *